US008146683B2

(12) United States Patent
McClain et al.

(10) Patent No.: US 8,146,683 B2
(45) Date of Patent: Apr. 3, 2012

(54) DRILLING OUT CASING BITS WITH OTHER CASING BITS

(75) Inventors: Eric E. McClain, Spring, TX (US); John C. Thomas, Lafayette, LA (US)

(73) Assignee: Baker Hughes Incorporated, Houston, TX (US)

( * ) Notice: Subject to any disclaimer, the term of this patent is extended or adjusted under 35 U.S.C. 154(b) by 318 days.

(21) Appl. No.: 12/200,344

(22) Filed: Aug. 28, 2008

(65) Prior Publication Data

US 2011/0168448 A9 Jul. 14, 2011

Related U.S. Application Data

(60) Continuation-in-part of application No. 12/129,308, filed on May 29, 2008, now Pat. No. 8,006,785, which is a division of application No. 10/783,720, filed on Feb. 19, 2004, now Pat. No. 7,395,882, application No. 12/200,344, which is a continuation-in-part of application No. 11/234,076, filed on Sep. 23, 2005, now Pat. No. 7,624,818.

(51) Int. Cl.
*E21B 7/00* (2006.01)

(52) U.S. Cl. ..... 175/57; 175/412; 166/242.7

(58) Field of Classification Search ..... 166/242.7; 175/426, 412, 57
See application file for complete search history.

(56) References Cited

U.S. PATENT DOCUMENTS

| | | | | |
|---|---|---|---|---|
| 3,997,009 | A | 12/1976 | Fox | |
| 4,624,316 | A | 11/1986 | Baldridge et al. | |
| 5,379,835 | A | 1/1995 | Streich | |
| 5,450,903 | A | 9/1995 | Budde | |
| 5,706,906 | A * | 1/1998 | Jurewicz et al. | 175/428 |
| 5,720,357 | A * | 2/1998 | Fuller et al. | 175/428 |
| 5,842,517 | A | 12/1998 | Coone | |
| 5,960,881 | A | 10/1999 | Allamon et al. | |
| 6,408,958 | B1 * | 6/2002 | Isbell et al. | 175/431 |
| 6,497,291 | B1 | 12/2002 | Szarka | |
| 7,334,650 | B2 | 2/2008 | Giroux et al. | |
| 2004/0124010 | A1 | 7/2004 | Galloway et al. | |
| 2005/0183892 | A1 | 8/2005 | Oldham et al. | |
| 2006/0070771 | A1 * | 4/2006 | McClain et al. | 175/57 |

OTHER PUBLICATIONS

International Search Report for International Application No. PCT/US2009/055272 mailed Mar. 3, 2010, 7 pages.

Written Opinion for International Application No. PCT/US2009/055272 mailed Mar. 3, 2010, 6 pages.

* cited by examiner

*Primary Examiner* — Daniel P Stephenson
*Assistant Examiner* — Kipp Wallace
(74) *Attorney, Agent, or Firm* — TraskBritt

(57) ABSTRACT

A drilling assembly for drilling two or more casing sections into a subterranean formation includes a first casing bit and a second casing bit, each casing bit of different diameter affixed to a respective casing section of different diameter, at least two casing bits and the two or more casing sections arranged in a telescoping relationship. The second casing bit includes a bit body having a face on which two different types of cutting elements are disposed, the first type being cutting elements for drilling at least one subterranean formation and the second type being cutting elements for drilling through the first casing bit.

29 Claims, 11 Drawing Sheets

DRILLING OUT CASING BITS WITH OTHER CASING BITS

CROSS-REFERENCE TO RELATED APPLICATIONS

This application is a continuation-in-part of U.S. patent application Ser. No. 12/129,308, filed May 29, 2008, now U.S. Pat. No. 8,006,785, issued Aug. 30, 2011, which is a divisional of U.S. patent application Ser. No. 10/783,720, filed Feb. 19, 2004, now U.S. Pat. No. 7,395,882 B2, issued Jul. 8, 2008. This application is also a continuation-in-part of U.S. patent application Ser. No. 11/234,076, filed Sep. 23, 2005, now U.S. Pat. No. 7,624,818, issued Dec. 1, 2009.

BACKGROUND OF THE INVENTION

1. Field of the Invention

The present invention relates generally to drilling a subterranean borehole and, more specifically, drilling structures disposed on the end of a casing or liner.

2. State of the Art

The drilling of wells for oil and gas production conventionally employs longitudinally extending sections or so-called "strings" of drill pipe to which, at one end, is secured a drill bit of a larger diameter. After a selected portion of the borehole has been drilled, the borehole is usually lined or cased with a string or section of casing. Such a casing or liner usually exhibits a larger diameter than the drill pipe and a smaller diameter than the drill bit. Therefore, drilling and casing according to the conventional process typically require sequentially drilling the borehole using a drill string with a drill bit attached thereto, removing the drill string and drill bit from the borehole, and disposing casing into the borehole. Further, often after a section of the borehole is lined with casing, which is usually cemented into place, additional drilling beyond the end of the casing may be desired.

However, sequential drilling and casing may be time consuming and costly because at the considerable depths the time required to implement complex retrieval procedures to recover the drill string may be lengthy.

BRIEF SUMMARY OF THE INVENTION

The drilling of a casing bit and any other equipment in the casing with another casing bit where at least two casing bits of different diameter and having associated casing sections may be assembled to form a drilling assembly for drilling subterranean formations, wherein the at least two casing bits and casing sections are arranged in a telescoping relationship.

The features and advantages of the present invention will become apparent to those of ordinary skill in the art through consideration of the ensuing description, the accompanying drawings, and the appended claims.

BRIEF DESCRIPTION OF THE SEVERAL VIEWS OF THE DRAWINGS

In the drawings, which illustrate what is currently considered to be the best mode for carrying out the invention:

FIGS. 7A-7H show schematically other configurations of cutting elements suitable for drilling through a casing bit and, if present, cementing equipment components within a casing above the casing bit, wherein FIGS. 7A, 7C, 7E and 7G show transverse configurations of the cutting elements, and FIGS. 7B, 7D, 7F and 7H show side views;

DETAILED DESCRIPTION OF THE INVENTION

In the present invention, at least two casino bits of different diameter and having associated casing sections may be assembled to form a drilling assembly for drilling into subterranean formations, wherein radially adjacent casing sections are selectively releasably affixed to one another and wherein the at least two casing bits and casing sections are arranged in a telescoping relationship. Such a configuration may reduce the time needed to dispose the casing sections that are attached to each larger and smaller casing bit into the borehole.

Figure 1A:
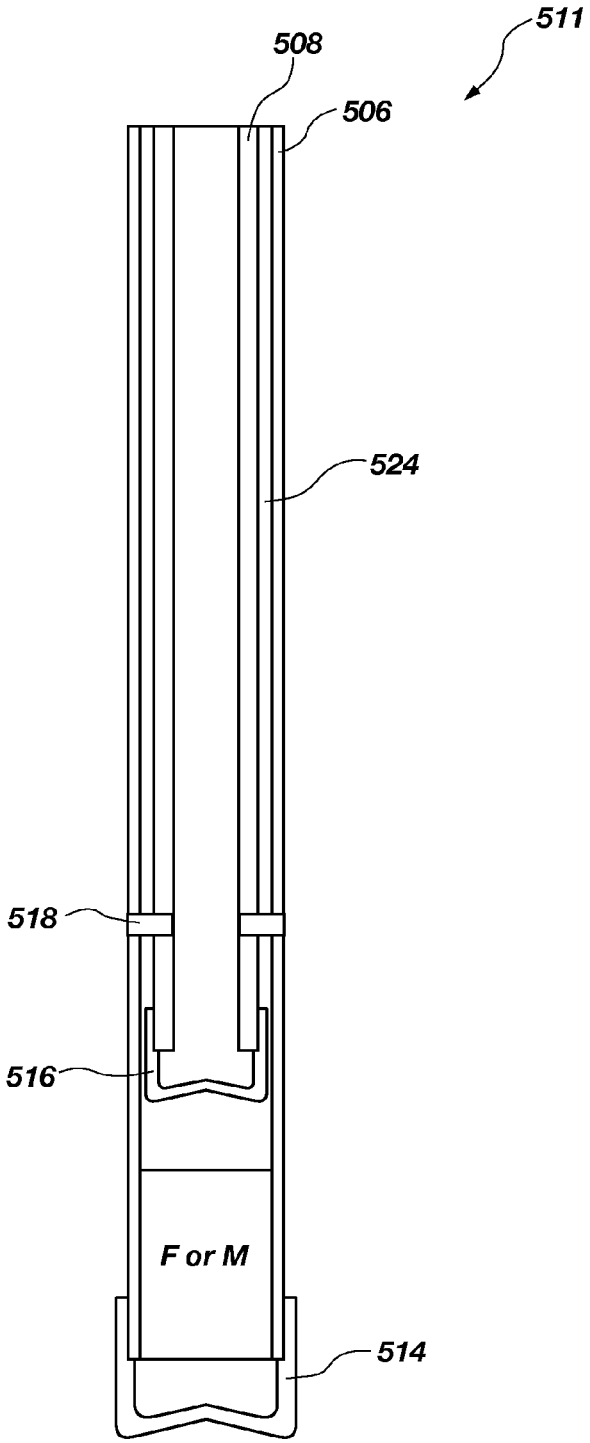
FIG. 1A shows a schematic cross-sectional view of a drilling assembly including two casing bits arranged in a nested telescoping relationship.
Figure 1B:
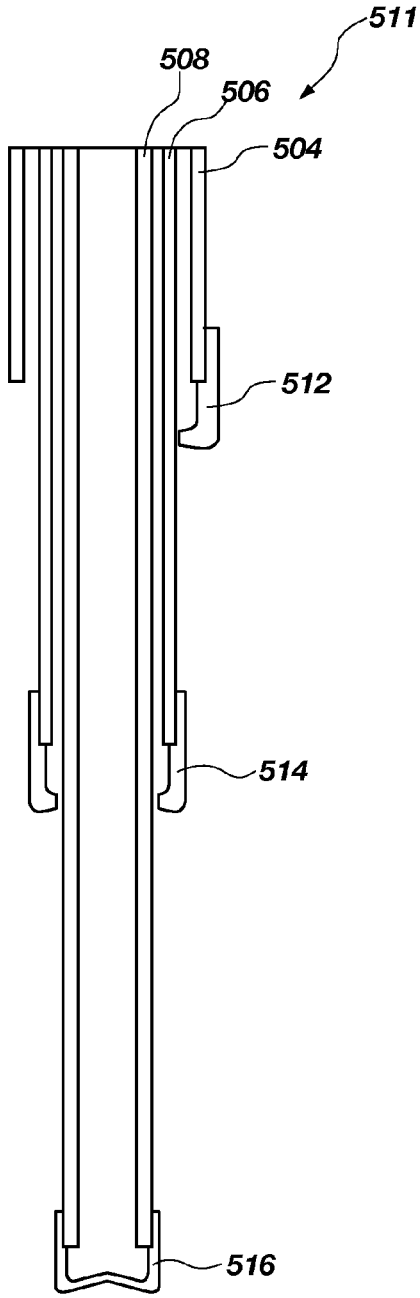
FIG. 1B shows a schematic cross-sectional view of the drilling assembly shown in FIG. 1A in an extended telescoping relationship.

For example, as shown in FIGS. 1A and 1B, drilling assembly 511 may include a first casing bit 516 and a second casing bit 514, wherein the first casing bit 516 is disposed within the second casing bit 514. First casing bit 516 may be affixed to casing section 508 and second casing bit 514 may be affixed to casing section 506. Thus, the casing sections 506 and 508 may be configured in a telescoping relationship, i.e., capable of being extended from or within one another. As shown in FIG. 1A, casing section 508 is affixed to casing section 506 by way of frangible elements 518. Frangible elements 518 may be configured to transmit torque, axial force or weight-on-bit (WOB), or both, between casing sections 506 and 508. Of course, other structures for transmitting forces between the casing sections 506 and 508 may be utilized. The casing section 506 may include cement floating equipment of cementing equipment component assembly F or downhole motor M connected thereto and/or second casing bit 514.

Therefore, during operation, torque and WOB may be applied to second casing bit 514 through casing section 506. Alternatively, torque and WOB may be applied to second casing bit 514 by way of casing section 508 and through frangible elements 518. As may be appreciated, when the casing bits 514 and 516 are structurally coupled to one another, torque, WOB, or both, may be transmitted therebetween. In addition, the fluid ports or apertures between each of the casing bits 514 and 516 may be coupled so that drilling fluid may be delivered through the interior of first casing bit 516 to second casing bit 514. Alternatively, drilling fluid may be delivered through annulus 524, while the ports or apertures of first casing bit 516 may be plugged or blocked. Thus, many alternatives are possible for delivering drilling fluid to any of casing bits 514 and 516.

As shown in FIG. 1B, a casing section 504 may be disposed at a first depth. Then, second casing bit 514 may be caused to drill past casing bit 512 and continue drilling to a second depth. Upon reaching a second depth, torque, WOB, or both, may be applied to cause frangible elements to fail or fracture. Alternatively, a frangible element may be caused to fail by way of selectively detonating a pyrotechnic agent, an explosive agent, or both. Thus, first casing bit 516 may be employed to drill through second casing bit 514 and to a third depth. Put another way, FIG. 1B shows drilling assembly 511 in an extended telescoping relationship. Of course, the present invention is not limited to any particular number of casing bits configured in a telescoping relationship. Rather, a drilling assembly of the present invention may include one or more casing bits disposed at least partially within one or more other casing bits in a telescoping relationship. It should also be understood that the present invention is not limited to a smaller casing bit or casing section being positioned at least partially within another casing bit to be configured in a telescoping relationship. Rather, more specifically, a casing bit or casing section may be disposed within another casing section, which may be affixed to another, larger casing bit, to be configured in a telescoping relationship.

Figure 1C:
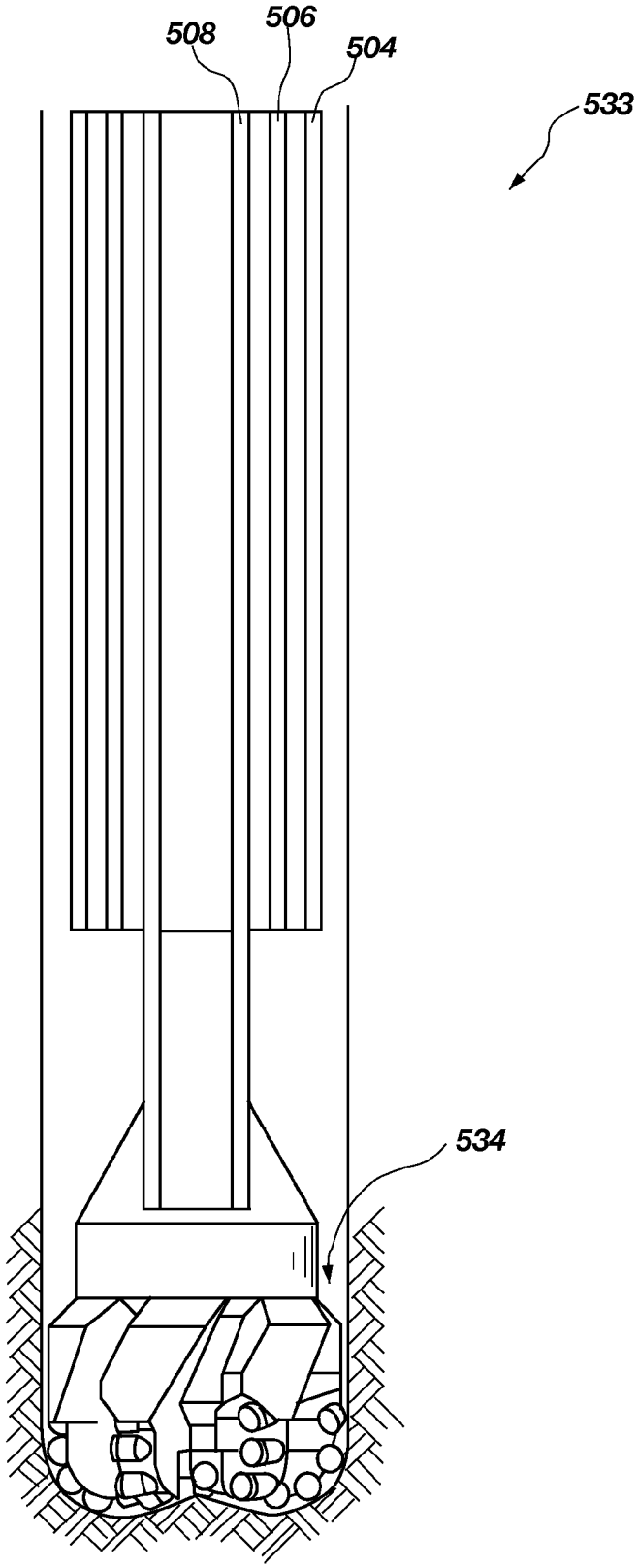
FIG. 1C shows a schematic cross-sectional view of a drilling assembly according to the present invention including three casing sections and a rotary drill bit.

Alternatively, an assembly of two of more casing sections configured in a telescoping relationship may be drilled into a subterranean formation by a drilling tool disposed at the leading end thereof. Specifically, as shown in FIG. 1C, illustrating a drilling assembly 533, casing sections 504, 506, and 508 may be coupled together by way of, for example, latching casing sections 504, 506, and 508 together to form an assembly that may be drilled into a formation by a conventional drilling tool 534 disposed at the leading end, in the direction of drilling, of the drilling assembly 533, the drilling tool 534 having a diameter that exceeds the diameter of the largest casing section 504. Drilling tool 534 may comprise a rotary drill bit, a reamer, a reaming assembly, or a casing bit, without limitation. The drilling tool 534 may precede into the formation by rotation and translation of the casing sections 504, 506, and 508. However, preferably, the drilling tool 534 may be structurally coupled to the innermost casing section 508, so that drilling tool 534 may continue to drill into the formation notwithstanding casing sections 504 or 506 becoming disposed within the borehole. Optionally, a downhole motor may be positioned between the innermost casing section 508 and the drilling tool 534.

As the drilling assembly proceeds into the formation, radially adjacent smaller casing sections may be unlatched from radially adjacent larger casing sections and extended therefrom. Of course, frangible elements (not shown) as described hereinabove (FIG. 1A) may structurally connect casing sections 504, 506, and 508 to one another. Forces may be applied to fail such frangible elements, or incendiary or explosive components may be employed for failing frangible elements. It is noted that a conventional drilling tool 534 may not be suited to allow another drilling tool to drill therethrough. However, the telescoping relationship between the casing sections 504, 506, and 508 may provide advantage in reducing the tripping operations for disposing the casing sections 504, 506, and 508 within the borehole.

Figure 1D:
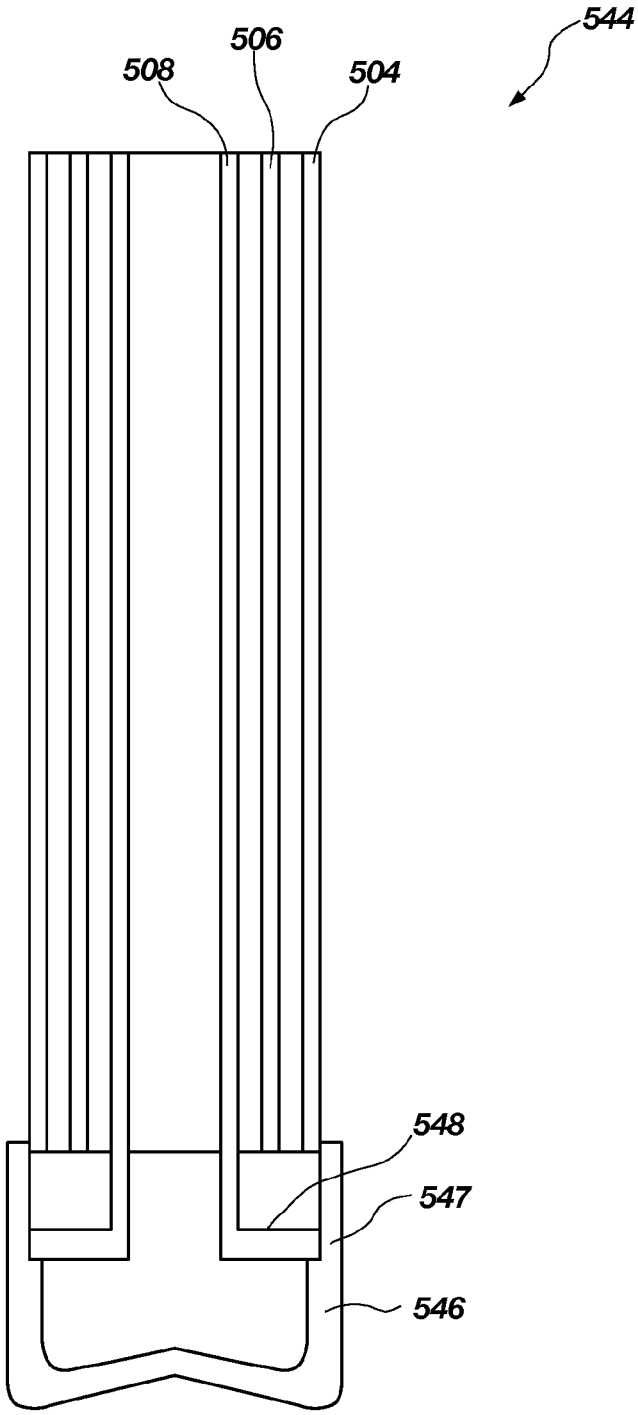
FIG. 1D shows a schematic cross-sectional view of a drilling assembly according to the present invention including a casing bit of the present invention and three casing sections.

Additionally, an assembly of two of more casing sections configured in a telescoping relationship may be drilled into a subterranean formation by a casing bit disposed at the leading end thereof. As shown in FIG. 1D, a drilling assembly 544 including casing sections 504, 506, and 508 may be drilled into a formation by a casing bit 546 of the present invention. However, the casing bit 546 may be primarily coupled to the innermost casing section 508, as illustrated by radially extending flange 548 and attachment surface 547, so that casing bit 546 may continue to drill into the formation notwithstanding casing sections 504 or 506 becoming disposed within the borehole, as well as being separated from casing section 508.

Figure 2:
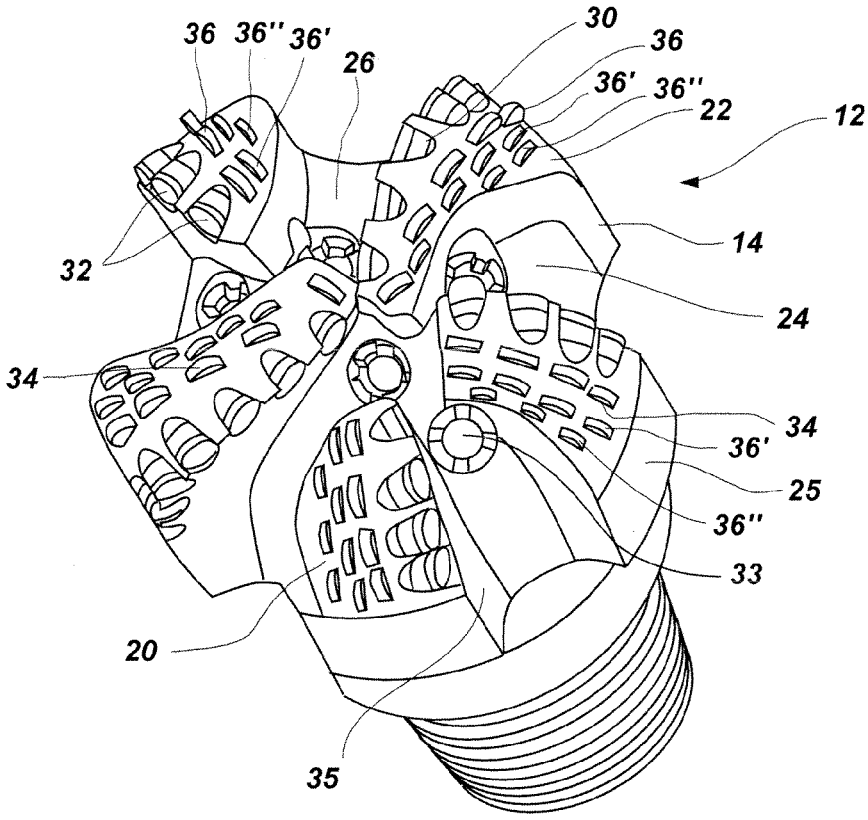
FIG. 2 shows a perspective view of a drill bit of the present invention.
Figure 3:
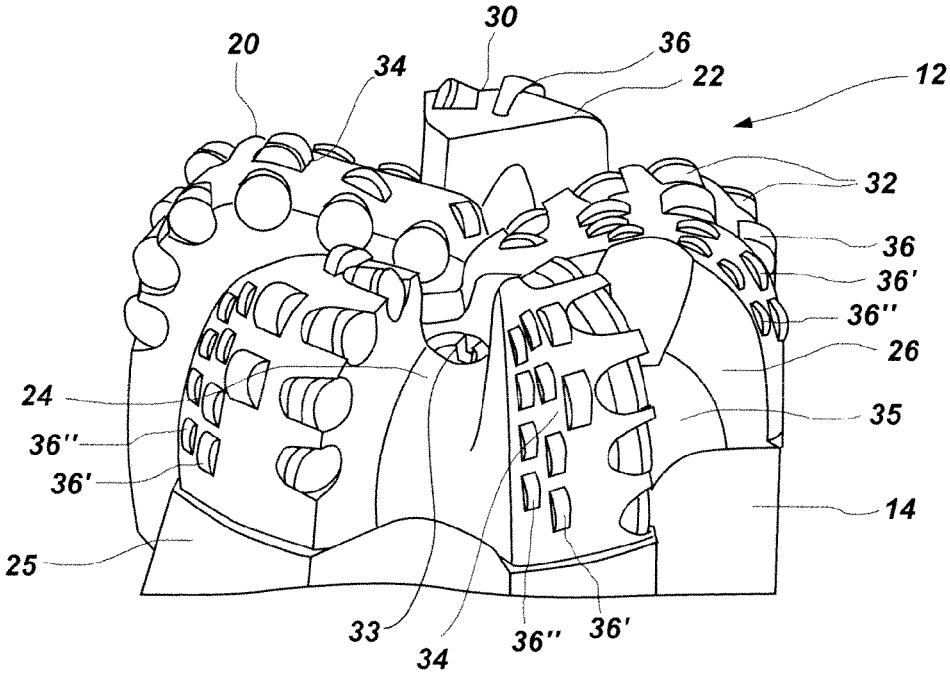
FIG. 3 shows an enlarged perspective view of a portion of another drill bit of the present invention.
Figure 4:
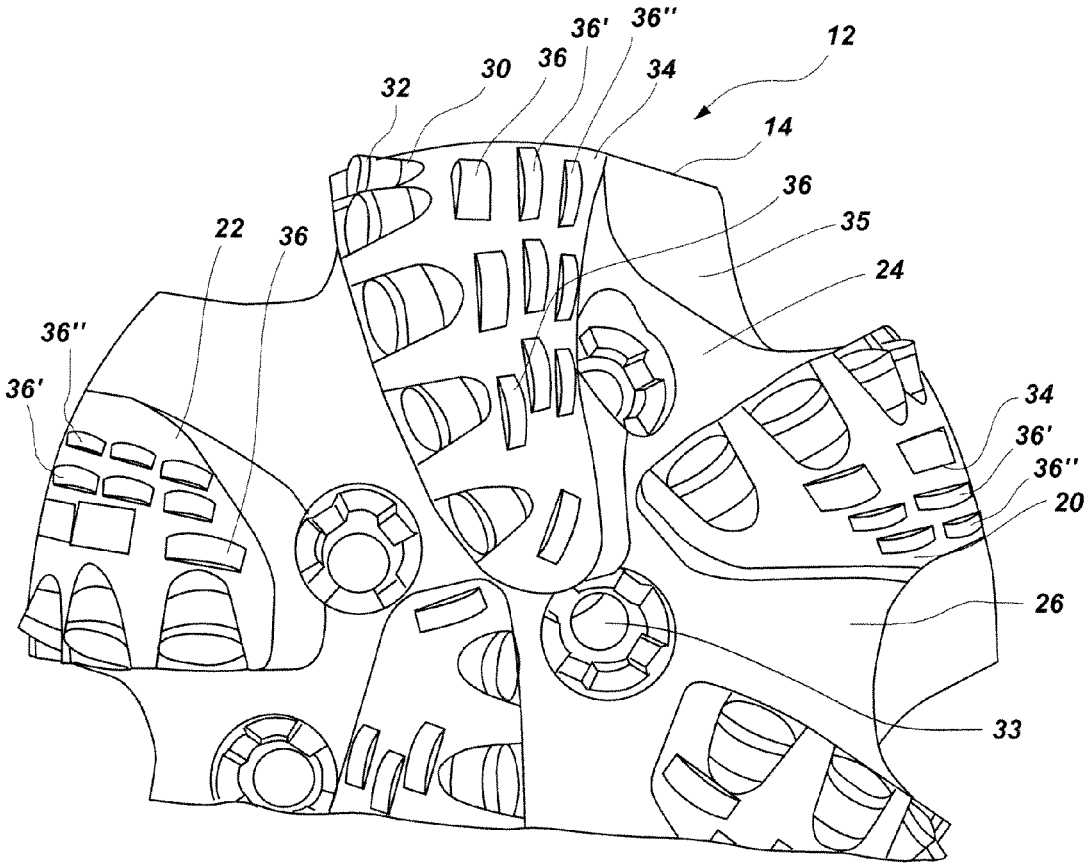
FIG. 4 shows an enlarged view of the face of the drill bit of FIG. 2.

FIGS. 2-4 illustrate several variations of an embodiment of a drill bit 12 in the form of a fixed cutter or so-called "drag" bit, according to the present invention, which corresponds to first casing bit 516 in FIG. 1A and drilling tool 534 and casing bit 546 in FIGS. 1C and 1D. For the sake of clarity, like numerals have been used to identify like features in FIGS. 2-4. As shown in FIGS. 2-4, drill bit 12 includes a bit body 14 having a face 26 and generally radially extending blades 22, forming fluid courses 24 therebetween extending to junk slots 35 between circumferentially adjacent blades 22. Bit body 14 may comprise a tungsten carbide matrix or a steel body, both as well known in the art. Blades 22 may also include pockets 30, which may be configured to receive cutting elements of one type such as, for instance, superabrasive cutting elements in the form of PDC cutting elements 32. Generally, such a PDC cutting element may comprise a superabrasive region that is bonded to a substrate. Rotary drag bits employing PDC cutting elements have been employed for several decades. PDC cutting elements are typically comprised of a disc-shaped diamond "table" formed on and bonded under a high-pressure and high-temperature (HPHT) process to a supporting substrate such as cemented tungsten carbide (WC), although other configurations are known. Drill bits carrying PDC cutting elements, which, for example, may be brazed into pockets in the bit face, pockets in blades extending from the face, or mounted to studs inserted into the bit body, are known in the art. Thus, PDC cutting elements 32 may be affixed upon the blades 22 of drill bit 12 by way of brazing, welding, or as otherwise known in the art. It is also contemplated that cutting elements 32 may comprise suitably mounted and exposed natural diamonds, thermally stable polycrystalline diamond compacts, cubic boron nitride compacts, or diamond grit-impregnated segments, as known in the art and as may be selected in consideration of the subterranean formation or formations to be drilled.

Also, each of blades 22 may include a gage region 25, which is configured to define the outermost radius of the drill bit 12 and, thus, the radius of the wall surface of a borehole drilled thereby. Gage regions 25 comprise longitudinally upward (as the drill bit 12 is oriented during use) extensions of blades 22, extending from nose portion 20 and may have wear-resistant inserts or coatings, such as cutting elements in the form of gage trimmers of natural or synthetic diamond, or hardfacing material, on radially outer surfaces thereof as known in the art to inhibit excessive wear thereto.

Drill bit 12 may also be provided with, for example, pockets 34 in blades 22, which may be configured to receive abrasive cutting elements 36, 36', 36" of another type different from the first type such as, for instance, tungsten carbide cutting elements. It is also contemplated, however, that abrasive cutting elements 36, 36', 36" may comprise, for example, a carbide material other than tungsten (W) carbide, such as a Ti, Mo, Nb, V, Hf, Ta, Cr, Zr, Al, and Si carbide, or a ceramic. However, abrasive cutting elements 36, 36', 36" may be configured the same as cutting elements 32 depending upon the material composition to be drilled by abrasive cutting elements 36, 36', 36". Abrasive cutting elements 36, 36', 36" may be secured within pockets 34 by welding, brazing or as otherwise known in the art. As depicted in FIG. 2, abrasive cutting elements 36, 36', 36" may be of substantially uniform thickness, taken in the direction of intended bit rotation. As shown in FIGS. 3 and 4, abrasive cutting elements 36, 36', 36" may be of varying thickness, taken in the direction of bit rotation, wherein abrasive cutting elements 36, 36', 36" at more radially outwardly locations (and, thus, which traverse relatively greater distance for each rotation of drill bit 12 than those, for example, within the cone of drill bit 12) may be thicker to ensure adequate material thereof will remain for cutting casing components and cement until they are to be worn away by contact with formation material after the casing components and cement are penetrated.

Figure 5:
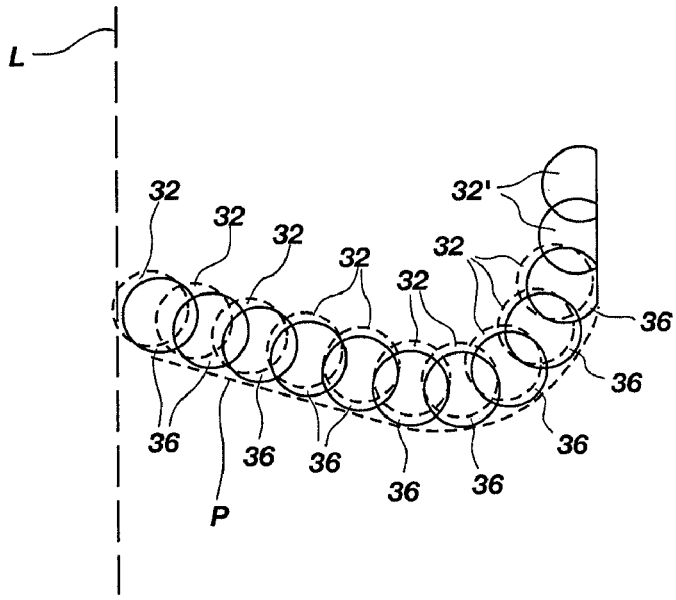
FIG. 5 shows a schematic side cross-sectional view of a cutting element placement design of a drill bit according to the present invention showing relative exposures of first and second types of cutting elements disposed thereon.
Figure 6A:
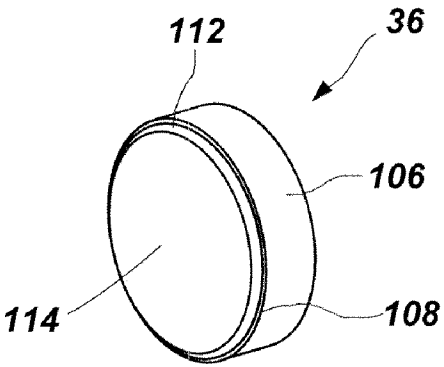
FIG. 6A is a perspective view of one configuration of a cutting element suitable for drilling through a casing bit and, if present, cementing equipment components within a casing above the casing bit.
Figure 6B:
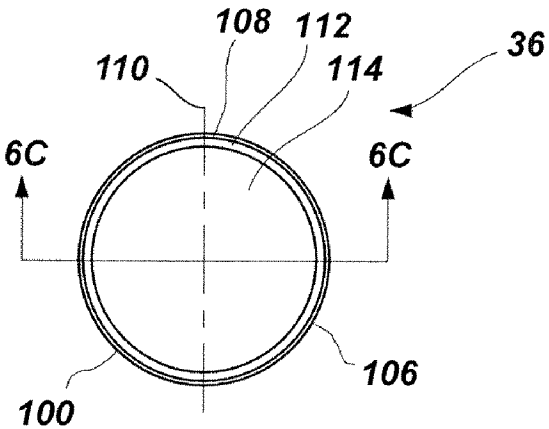
FIG. 6B is a frontal view of the cutting element shown in FIG. 6A.
Figure 6C:
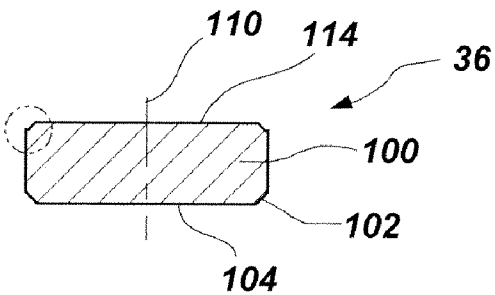
FIG. 6C is a sectional view taken through line 6C-6C on FIG. 6B.
Figure 6D:
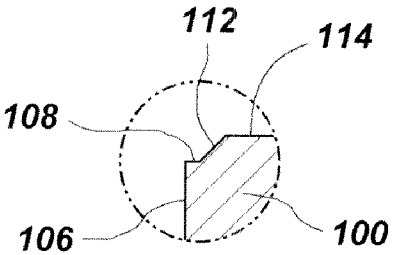
FIG. 6D is an enlarged view of the cutting edge of the cutting element in the circled area of FIG. 6C.

As shown in FIGS. 3-5, abrasive cutting elements 36, 36', 36" may be placed in an area from the cone of the drill bit 12 out to the shoulder (in the area from the centerline L to gage regions 25) to provide maximum protection for cutting elements 32, which are highly susceptible to damage when drilling casing assembly components. Broadly, cutting elements 32 on face 26, which may be defined as surfaces at less than 90° profile angles, or angles with respect to centerline L, are desirably protected. Cutting elements 36, 36', 36" may also be placed selectively along the profile of the face 26 to provide enhanced protection to certain areas of the face 26 and cutting elements 32 thereon.

Superabrasive cutting elements 32 and abrasive cutting elements 36, 36', 36" may be respectively dimensioned and configured, in combination with the respective depths and locations of pockets 30 and 34, to provide abrasive cutting elements 36, 36', 36" with a greater relative exposure than superabrasive cutting elements 32. As used herein, the term "exposure" of a cutting element generally indicates its distance of protrusion above a portion of a drill bit, for example a blade surface or the profile thereof, to which it is mounted. However, in reference specifically to the present invention, "relative exposure" is used to denote a difference in exposure between a cutting element 32 of the one type and a cutting element 36, 36', 36" of the another, different type. More specifically, the term "relative exposure" may be used to denote a difference in exposure between one cutting element 32 of the one type and another cutting element 36, 36', 36" of the another, different type which are proximately located on drill bit 12 at similar radial positions relative to a centerline L (see FIG. 5) of drill bit 12 and which, optionally, may be proximately located in a direction of bit rotation. In the embodiment depicted in FIGS. 2-4, abrasive cutting elements 36, 36', 36" may generally be described as rotationally "following" superabrasive cutting elements 32 and in close rotational proximity to on the same blade 22, as well as being located at substantially the same radius. However, abrasive cutting elements 36, 36', 36" may also be located to rotationally "lead" associated superabrasive cutting elements 32.

By way of illustration of the foregoing, FIG. 5 shows a schematic side view of a cutting element placement design for drill bit 12 showing cutting elements 32 as disposed on a drill bit (not shown) such as drill bit 12 of the present invention in relation to the longitudinal axis or centerline L and drilling profile P thereof, as if all the cutting elements 32, 32', and 36 were rotated onto a single blade (not shown). Particularly, one plurality of cutting elements 36 may be sized, configured, and positioned so as to engage and drill a first material or region, such as a casing shoe, casing bit, cementing equipment component or other downhole component. Further, the one plurality of cutting elements 36 may be configured to drill through a region of cement that surrounds a casing shoe, if it has been cemented within a wellbore, as known in the art. In addition, another plurality of cutting elements 32 may be sized, configured, and positioned to drill into a subterranean formation. Also, cutting elements 32' are shown as configured with radially outwardly oriented flats and positioned to cut a gage diameter of drill bit 12, but the gage region of the cutting element placement design for drill bit 12 may also include cutting elements 32 and 36 of the first and second plurality, respectively. The present invention contemplates that the one plurality of cutting elements 36 may be more exposed than the another plurality of cutting elements 32. In this way, the one plurality of cutting elements 36 may be sacrificial in relation to the another plurality of cutting elements 32. Explaining further, the one plurality of cutting elements 36, 36', 36" may be configured to initially engage and drill through materials and regions that are different from subsequent materials and regions that the another plurality of cutting elements 32 is configured to engage and drill through.

Accordingly, the one plurality of cutting elements 36, 36', 36" may be configured differently than the another plurality of cutting elements 32. Particularly, and as noted above, the one plurality of cutting elements 36, 36', 36" may comprise tungsten carbide cutting elements, while the another plurality of cutting elements 32 may comprise PDC cutting elements. Such a configuration may facilitate drilling through a casing shoe or bit, as well as cementing equipment components within the casing on which the casing shoe or bit is disposed, as well as the cement thereabout with primarily the one plurality of cutting elements 36, 36', 36". However, upon passing into a subterranean formation, the abrasiveness of the subterranean formation material being drilled may wear away the tungsten carbide of cutting elements 36, 36', 36", and the another plurality of PDC cutting elements 32 may engage the formation. As shown in FIGS. 2-4, one or more of the another plurality of cutting elements 32 may rotationally precede one or more of the one plurality of cutting elements 36, 36', 36", without limitation. Alternatively, one or more of the another plurality of cutting elements 32 may rotationally follow one or more of the one plurality of cutting elements 36, 36', 36", without limitation.

During drilling with drill bit 12, fluid courses 24 between circumferentially adjacent blades 22 may be provided with drilling fluid flowing through nozzles 33 secured in apertures at the outer ends of passages that extend between the interior of the drill bit 12 and the face 26 thereof. Cuttings of material from engagement of cutting elements 32 or 36, 36', 36" are swept away from the cutting elements 32 and 36, 36', 36", and cutting elements 32 and 36, 36', 36" are cooled by drilling fluid or mud pumped down the bore of a drill string on which drill bit 12 is disposed and emanating from nozzles 33, the fluid moving generally radially outwardly through fluid courses 24 and then upwardly through junk slots 35 to an annulus between an interior wall of a casing section within which the drill bit 12 is suspended and the exterior of a drill string on which drill bit 12 is disposed. Of course, after drill bit 12 has drilled through the end of the casing assembly, an annulus is formed between the exterior of the drill string and the surrounding wall of the borehole.

FIGS. 6A-6D depict one example of a suitable configuration for cutting elements 36, 36', 36", including a disc-like body 100 of tungsten carbide or other suitable material and having a circumferential chamfer 102 at the rear (taken in the direction of intended cutter movement) thereof, surrounding a flat rear surface 104. A cylindrical side surface 106 extends from circumferential chamfer 102 to an annular flat 108 oriented perpendicular to longitudinal axis 110 and extending inwardly to offset chamfer 112, which leads to flat cutting face 114. An area from the junction of side surface 106 with annular flat 108 to the junction of offset chamfer 112 with cutting face 114 may be generally termed the cutting edge area, for the sake of convenience. The angles of circumferential chamfer 102 and offset chamfer 112 may be, for example, 45° to longitudinal axis 110. However, other angles are contemplated and a specific angle is not limiting of the present invention. Cutting elements 36 may be disposed on the face 26 (as on blades 22) of drill bit 12 (FIG. 2) at, for example, a forward rake, a neutral (about 0° angle) rake or a back rake of up to about 25°, for effective cutting of a casing shoe, casing bit, cementing equipment components, and cement, although a specific range of back rakes for cutting elements 36, 36', 36" is not limiting of the present invention.

Figure 7A:
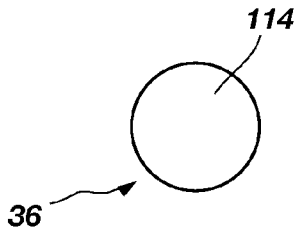
Figure 7B:
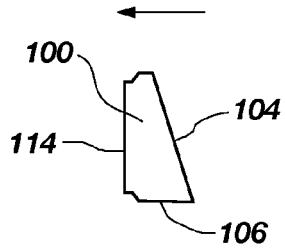
Figure 7C:
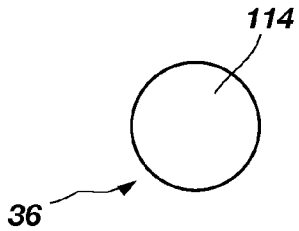
Figure 7D:
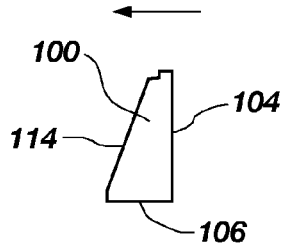
Figure 7E:
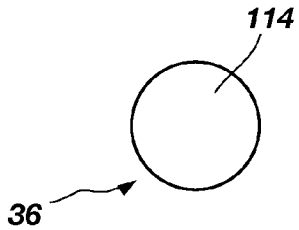
Figure 7F:
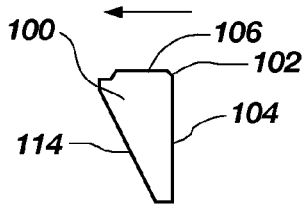
Figure 7G:
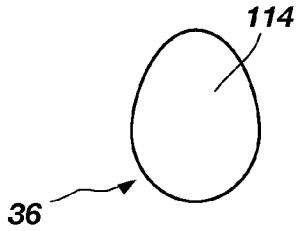
Figure 7H:
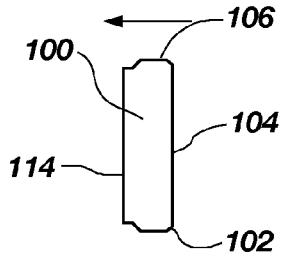

FIGS. 7A-7H depict other suitable configurations for cutting elements 36, 36', 36". The cutting element 36, 36', 36" depicted in FIGS. 7A and 7B is circular in transverse configuration and, as shown in FIG. 7B, has a cutting edge area configured similar to that of cutting element 36 depicted in FIGS. 6A-6D. However, rear surface 104 is sloped toward the front of the cutting element (in the intended cutting direction shown by the arrow), providing a thicker base and a thinner outer edge for cutting, to enhance faster wear when formation material is engaged. The cutting element 36, 36', 36" depicted in FIGS. 7C and 7D is also circular in transverse configuration and, as shown in FIG. 7D, has a cutting edge area configured similar to that of cutting element 36, 36', 36" depicted in FIGS. 6A-6D. However, cutting face 114 is sloped toward the rear of the cutting element, providing a thicker base and a thinner outer edge for cutting, to enhance faster wear when formation material is engaged. The cutting element 36, 36', 36" depicted in FIGS. 7E and 7F is also circular in transverse configuration and, as shown in FIG. 7F, has a cutting edge area configuration similar to that of cutting element 36, 36', 36" depicted in FIGS. 6A-6D. However, cutting face 114 is sloped toward the rear of the cutting element from the cutting edge area, providing a thinner base and a thicker outer edge for cutting, to provide more cutting element material for extended cutting of casing components and the like. The cutting element 36, 36', 36" depicted in FIGS. 7G and 7H is ovoid or egg-shaped in transverse configuration and, as shown in FIG. 7H, has a cutting edge area similar to that of cutting element 36, 36', 36" depicted in FIGS. 6A-6D. Cutting face 114 and rear surface 104 are mutually parallel. The ovoid configuration provides enhanced loading of material being cut by the cutting element, to facilitate initial engagement thereby.

Figure 8A:
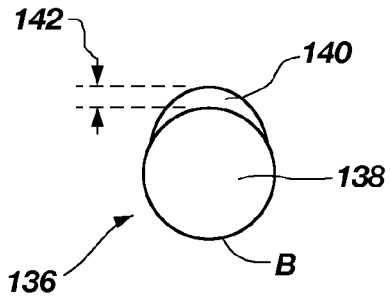
FIGS. 8A and 8B show a configuration of a dual-purpose cutting element suitable for first drilling through a casing bit and, if present, cementing equipment components and cement within a casing above the casing bit and subsequently drilling through a subterranean formation ahead of the casing bit.
Figure 8B:
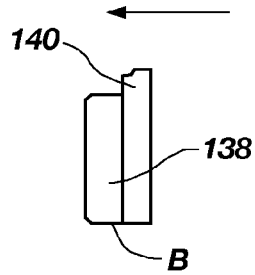

FIGS. 8A and 8B depict a cutting element 136 which may be disposed on a drill bit 12 (FIG. 2) to cut casing-associated components, as well as a subterranean formation, rather than using separate cutting elements for cutting casing-associated components and, subsequently, the subterranean formation. Cutting element 136 comprises a superabrasive element 138 bonded to an abrasive element 140, the outer transverse configuration of cutting element 136 being defined as an ovoid by abrasive element 140, superabrasive element 138 being of circular configuration and offset toward the base B of cutting element 136 to be tangentially aligned at the base B with abrasive element 140. Thus, an exposure of an outer extent of abrasive element 140 is greater than an exposure of an outer extent of superabrasive element 138, as shown at 142. The cutting edge area of abrasive element 140 may be, as shown in FIG. 8B, configured similarly to that of cutting element 36, 36', 36" depicted in FIGS. 6A and 6B. As cutting element 136 is mounted to a drill bit with the base B received in a single pocket on the bit face, the greater exposure of abrasive element 140 will enable it to contact casing-associated components (casing shoe, casing bit, cementing equipment and cement, etc.) and drill therethrough, after which engagement of abrasive element 140 with subterranean formation material will cause it to wear quickly and result in engagement of superabrasive element 138 with the formation.

While examples of specific cutting element configurations for cutting casing-associated components and cement, on the one hand, and subterranean formation material on the other hand, have been depicted and described, the invention is not so limited. The cutting element configurations as disclosed herein are merely examples of designs which the inventors believe are suitable. Other cutting element designs for cutting casing-associated components may employ, for example, a chamfer bridging between the side of the cutting element and the cutting face, rather than an offset chamfer, or no chamfer at all may be employed. Likewise, superabrasive cutting element design and manufacture is a highly developed, sophisticated technology, and it is well known in the art to match superabrasive cutting element designs and materials to a specific formation or formations intended to be drilled.

Figure 9:
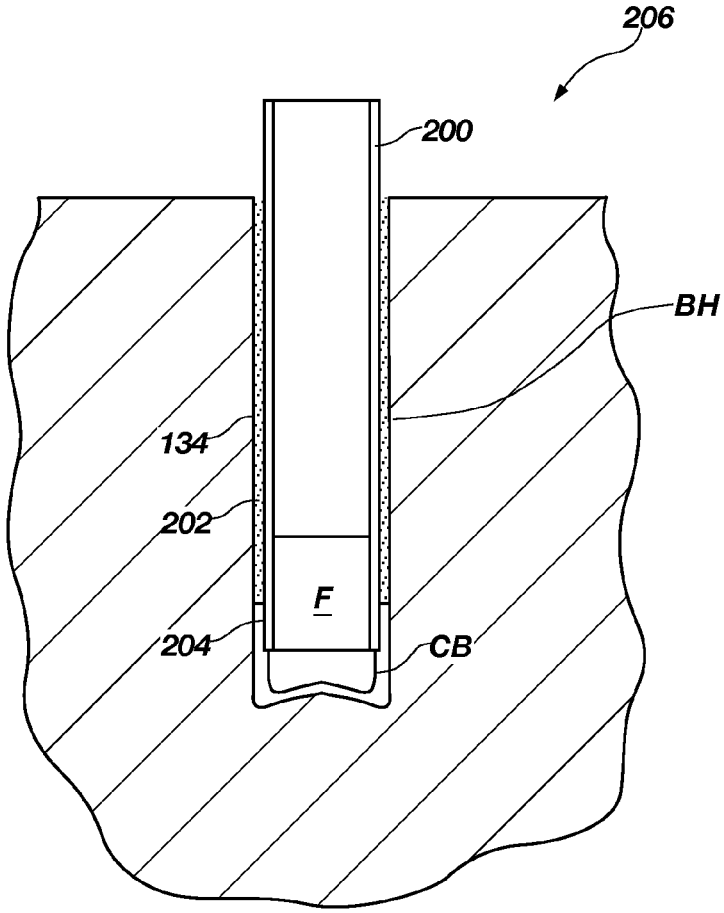
FIG. 9 shows schematically a casing assembly having a casing bit at the bottom thereof and a cementing equipment component assembly above the casing bit, the casing assembly disposed within a borehole.

As shown in FIG. 9, a casing section 200 and a casing bit CB disposed on the end 204 thereof may be surrounded by cement 202, or other hardenable material, so as to cement the casing bit CB and casing section 200 within borehole BH, after borehole BH is drilled. Cement 202 may be forced through the interior of casing section 200, through (for example) apertures formed in casing bit CB, and into the annulus formed between a wall 134 of borehole BH and the outer surface of the casing section 200. Of course, cementing equipment component assembly F as shown schematically above casing bit CB may be used for controlling and delivering the cement 202 to the casing bit CB. Cementing a casing bit assembly 206 into the borehole BH may stabilize the borehole BH and seal formations penetrated by borehole BH. In addition, it may be desirable to drill past the casing bit CB, so as to extend the borehole BH, as described in more detail hereinbelow.

Casing bit CB may include an integral stem section S (see FIG. 10) extending longitudinally from the nose portion of casing bit CB that includes one or more frangible regions. Alternatively, flow control equipment of cementing equipment component assembly F, such as float equipment, may be included within the integral stem section S of casing bit CB. Casing bit CB may include a threaded end for attaching the casing bit CB to a casing string, or it may be attached by another suitable technique, such as welding. Alternatively or additionally, casing bit CB may include, without limitation, a float valve mechanism, a cementing stage tool, a float collar mechanism, a landing collar structure, other cementing equipment, or combinations thereof, as known in the art, within an integral stem section S, or such components may be disposed within the casing string above casing bit CB.

More particularly, an integral stem sections of casing bit CB may include, as a cementing equipment component assembly F, cementing float valves as disclosed in U.S. Pat. No. 3,997,009 to Fox and U.S. Pat. No. 5,379,835 to Streich, the disclosures of which are incorporated by reference herein. Further, valves and sealing assemblies commonly used in cementing operations as disclosed in U.S. Pat. No. 4,624,316 to Baldridge et al. and U.S. Pat. No. 5,450,903 to Budde, the disclosures of each of which are incorporated by reference herein, may comprise cementing equipment component assembly F. Further, float collars as disclosed in U.S. Pat. No. 5,842,517 to Coone, the disclosure of which is incorporated in its entirety by reference herein, may comprise cementing equipment component assembly F. In addition, U.S. Pat. No. 5,960,881 to Allamon et al. and U.S. Pat. No. 6,497,291 to Szarka, the disclosures of which are incorporated in their entirety by reference herein, disclose cementing equipment which may comprise component assembly F. Any of the above-referenced cementing equipment, or mechanisms and equipment as otherwise known in the art, may be included within integral stem section S and may comprise cementing equipment component assembly F thereof.

Figure 10:
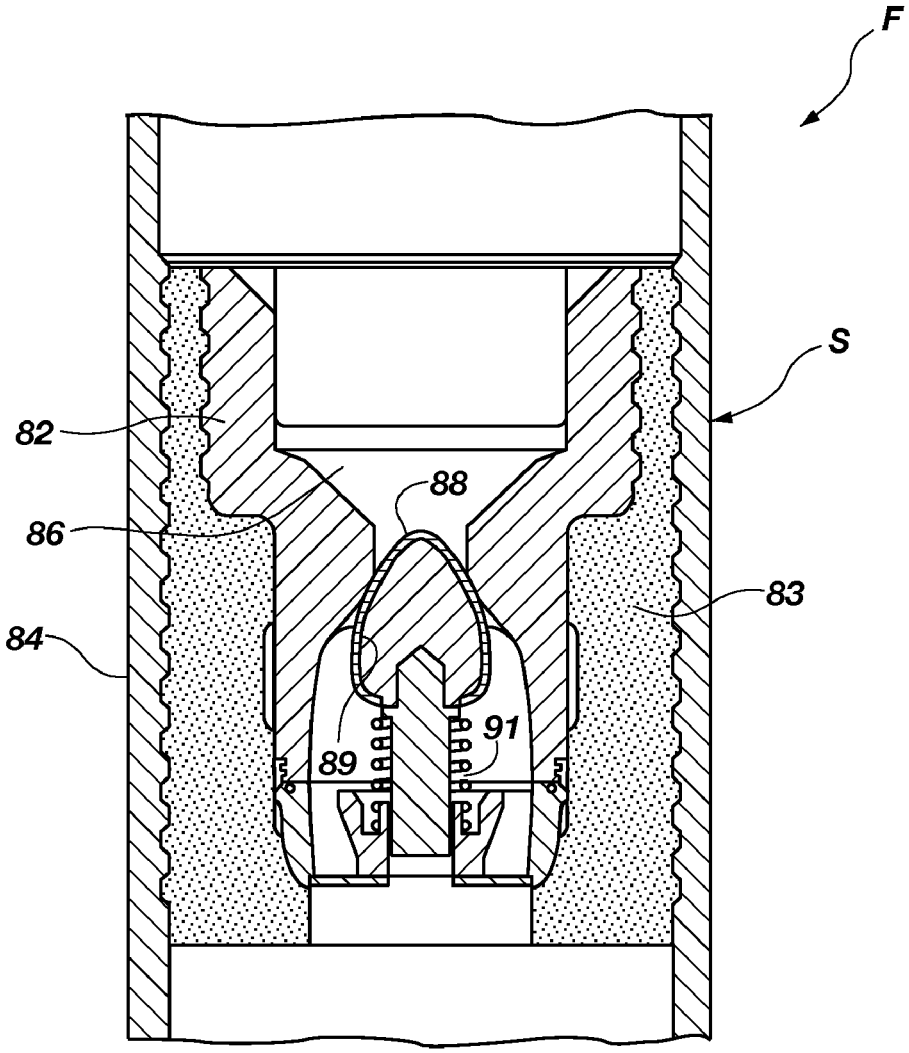
FIG. 10 shows a detailed, side cross-sectional view of an example cementing equipment component assembly such as might be used in the casing assembly of FIG. 7.

In one embodiment, cementing equipment component assembly F may comprise a float collar, as shown in FIG. 10, which depicts a partial side cross-sectional view of integral stem section S. As shown in FIG. 10, cementing equipment component assembly F may include an inner body 82 anchored within outer body 84 by a short column of cement 83, and having a bore 86 therethrough connecting its upper and lower ends. The bore 86 may be adapted to be opened and closed by check valve 88 comprising a poppet-type valve member 89 adapted to be vertically movable between a lower position opening bore 86 and an upper position closing bore 86, thus permitting flow downwardly therethrough, but preventing flow upwardly therethrough. Therefore, poppet-type valve member 89 may be biased to an upper position by biasing element 91, which is shown as a compression spring; however, other biasing mechanisms may be used for this purpose, such as a compressed gas or air cylinder or an arched spring. Thus, cement may be delivered through check valve 88 and through apertures (not shown) or frangible regions (not shown) formed within the integral stem section S or the integral casing bit CB, as discussed hereinabove.

After drilling borehole BH using casing bit assembly 206 and cementing casing bit assembly 206 within borehole BH, it may be desirable to drill through the end of casing bit assembly 206 and into the formation ahead of casing bit assembly 206, for which a drill bit of the present invention is especially suitable.

Figure 11:
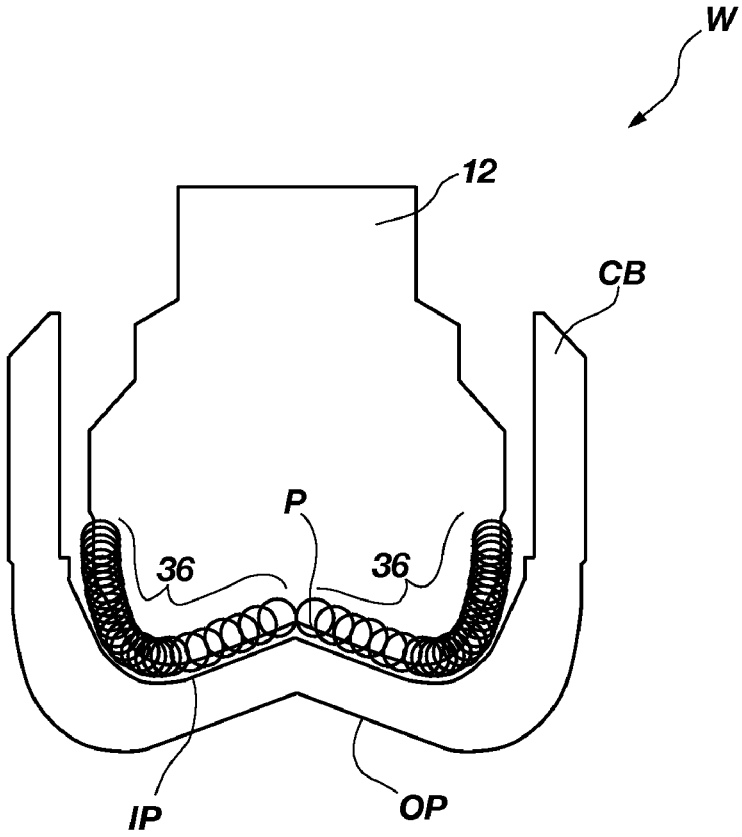
FIG. 11 shows a schematic cross-sectional view of a drill bit according to the present invention disposed within a casing bit having an inner profile, as well as an outer profile substantially conforming to a drilling profile defined by cutting elements of the drill bit.

Referring to FIG. 11 of the drawings, as discussed above, a casing bit CB may be affixed to a casing section and cemented within a borehole or wellbore (not shown), as known in the art. FIG. 11 shows a partial cross-sectional embodiment of a portion of a wellbore assembly W and a drill bit 12 according to the present invention disposed within the interior of casing bit CB for drilling therethrough. Wellbore assembly W is shown without a casing section attached to the casing bit CB, for clarity. However, it should be understood that the embodiments of wellbore assembly W as shown in FIG. 11 may include a casing section which may be cemented within a borehole as known in the art and as depicted in FIG. 9.

Generally, referring to FIG. 11, drill bit 12 may include a drilling profile P defined along its lower region that is configured for engaging and drilling through the subterranean formation. Explaining further, the drilling profile P of the drill bit 12 may be defined by cutting elements 36 that are disposed along a path or profile of the drill bit 12. Thus, the drilling profile P of drill bit 12 refers to the drilling envelope or drilled surface that would be formed by a full rotation of the drill bit 12 about its drilling axis (not shown). Of course, drilling profile P may be at least partially defined by generally radially extending blades 22 (not shown in FIG. 11, see FIGS. 2-4) disposed on the drill bit 12, as known in the art. Moreover, drilling profile P may include arcuate regions, straight regions, or both.

Casing bit CB may include an inner profile IP which substantially corresponds to the drilling profile P of drill bit 12. Such a configuration may provide greater stability in drilling through casing bit CB. Particularly, forming the geometry of drilling profile P of drill bit 12 to conform or correspond to the geometry of the inner profile IP of casing bit CB may enable cutting elements 36 of relatively greater exposure disposed on the drill bit 12 to engage the inner profile IP of casing bit CB at least somewhat concurrently, thus equalizing the forces, the torques, or both, of cutting therethrough.

For instance, referring to FIG. 11, the drilling profile P of drill bit 12 substantially corresponds to the inner profile IP of casing bit CB, both of which form a so-called "inverted cone." Put another way, the drilling profile P slopes longitudinally upwardly from the outer diameter of the drill bit 12 (oriented as shown in the drawing figure) toward the center of the drill bit 12. Therefore, as the drill bit 12 engages the inner profile IP of casing bit CB, the drill bit 12 may be, at least partially, positioned by the respective geometries of the drilling profile P of the drill bit 12 and the inner profile IP of the casing bit CB. In addition, because the cutting elements 36 of the drill bit 12 contact the inner profile IP of the casing bit CB substantially uniformly, the torque generated in response to the contact may be distributed, to some extent, more equally upon the drill bit 12.

As also shown in FIG. 11, the outer profile OP of casing bit CB of wellbore assembly W may have a geometry, such as an inverted cone geometry, that substantially corresponds to the drilling profile P of drill bit 12. In FIG. 5, all the cutting elements 36 are shown on each side (with respect to the central axis of the drill bit 12) of the drill bit 12, and are shown as if all the cutting elements 36 were rotated into a single plane. Thus, the lower surfaces (cutting edge areas) of the overlapping cutting elements 36 form the drilling profile P of drill bit 12, the drilling profile P referring to the drilling envelope formed by a full rotation of the drill bit 12 about its drilling axis (not shown).

As a further aspect of the present invention, a casing bit of the present invention may be configured as a reamer. A reamer is an apparatus that drills initially at a first smaller diameter and subsequently at a second, larger diameter. Although the present invention may refer to a "drill bit," the term "drill bit" as used herein also encompasses the structures which are referred to conventionally as casing bits, reamers and casing bit reamers.

Although the foregoing description contains many specifics, these should not be construed as limiting the scope of the present invention, but merely as providing illustrations of some exemplary embodiments. Similarly, other embodiments of the invention may be devised which do not depart from the spirit or scope of the present invention. Features from different embodiments may be employed in combination. The scope of the invention is, therefore, indicated and limited only by the appended claims and their legal equivalents, rather than by the foregoing description. All additions, deletions, and modifications to the invention, as disclosed herein, which fall within the meaning and scope of the claims are to be embraced thereby.

The invention claimed is:

1. A drilling assembly for drilling two or more casing sections into a subterranean formation comprising:

a first casing bit and a second, smaller casing bit, each casing bit of different diameter affixed to a respective casing section of different diameter, at least two casing bits and the two or more casing sections arranged in a telescoping relationship;

the second casing bit configured to drill out the first casing bit and comprising:

a bit body having a face at a leading end thereof;

a first plurality of cutting elements of at least one type disposed over the bit body, the cutting elements of the at least one type each exhibiting an exposure; and a second plurality of cutting elements of at least another, different type disposed over the bit body, each cutting element of the at least another, different type exhibiting an exposure relatively greater than an exposure of a proximate cutting element of the at least one type.

2. The drilling assembly of claim 1, wherein the second casing bit further includes a plurality of generally radially extending blades extending over the face, wherein at least one cutting element of the at least one type and at least one cutting element of the at least another, different type are disposed on each blade.

3. The drilling assembly of claim 2, wherein a plurality of cutting elements of the at least one type and a plurality of cutting elements of the at least another, different type are disposed on each blade.

4. The drilling assembly of claim 3, wherein at least some cutting elements of the at least one type have proximate thereto a cutting element of the at least another, different type.

5. The drilling assembly of claim 4, wherein the at least some cutting elements of the at least one type and the proximate cutting element of the at least another, different type are located at a substantially similar radius from a centerline of the second casing bit.

6. The drilling assembly of claim 2, wherein the cutting elements of the first and second pluralities of cutting elements are disposed in pockets formed in the generally radially extending blades of the plurality.

7. The drilling assembly of claim 6, wherein the at least one type of cutting elements comprises superabrasive cutting elements and the at least another, different type of cutting elements comprises abrasive cutting elements.

8. The drilling assembly of claim 7, wherein the superabrasive cutting elements comprise PDC cutting elements and the abrasive cutting elements comprise tungsten carbide cutting elements.

9. The drilling assembly of claim 1, wherein the at least one type of cutting elements comprises superabrasive cutting elements and the at least another, different type of cutting elements comprises abrasive cutting elements.

10. The drilling assembly of claim 9, wherein the superabrasive cutting elements comprise PDC cutting elements and the abrasive cutting elements comprise tungsten carbide cutting elements.

11. The drilling assembly of claim 1, wherein a central portion of an outer profile of the face is configured as an inverted cone and is surrounded by a nose.

12. The drilling assembly of claim 11, wherein at least a majority of the second plurality of cutting elements of the at least another, different type is disposed within the central portion of the outer profile of the face and on the nose.

13. The drilling assembly of claim 1, wherein cutting elements of the at least one type are selected from the group consisting of a PDC cutting element, a thermally stable diamond cutting element, and a natural diamond cutting element.

14. The drilling assembly of claim 1, wherein cutting elements of the at least another, different type are selected from the group consisting of a tungsten carbide cutting element, another metal carbide cutting element and a ceramic cutting element.

15. The drilling assembly of claim 1, wherein:

the second plurality of cutting elements is configured to initially engage and drill through a selected region; and the first plurality of cutting elements is configured to engage and drill through a region to be subsequently encountered by a drill bit.

16. The drilling assembly of claim 15, wherein each of the second plurality of cutting elements comprises a tungsten carbide cutting element and each of the first plurality of cutting elements comprises a PDC cutting element.

17. The drilling assembly of claim 1, wherein the second plurality of cutting elements is disposed between a centerline of a drill bit and a gage region thereof.

18. The drilling assembly of claim 1, wherein the second plurality of cutting elements is disposed over the face thereof.

19. The drilling assembly of claim 1, wherein cutting elements of the second plurality of cutting elements are oriented at a forward rake, a neutral (about 0°) rake or a back rake of up to about 25°.

20. The drilling assembly of claim 1, wherein at least some of the cutting elements of the second plurality include a cutting edge area defined by an annular flat leading from a side surface of the cutting elements to an offset chamfer terminating at a cutting face.

21. The drilling assembly of claim 1, wherein at least one cutting element of the one type and at least one cutting element of the at least another, different type are arranged together in a single structure and disposed in a single pocket on the bit body.

22. The drilling assembly of claim 1, wherein the two or more casing sections are affixed to one another by way of shear pins.

23. The drilling assembly of claim 1, wherein one or more casing bits of the at least two casing bits are disposed at least partially within one or more other casing bits of the at least two casing bits in a telescoping relationship.

24. The drilling assembly of claim 1, further comprising a third, smallest casing bit affixed to another respective casing section of a third, different diameter, the first, second, and third casing bits and the casing sections to which they are attached arranged in a telescoping relationship, the third, smallest casing bit configured to drill through the second, smaller casing bit.

25. A drilling assembly for drilling two or more casing sections into a subterranean formation comprising:

at least two casing sections of different diameter disposed in a telescoping relationship; and a drilling tool disposed at a longitudinally preceding end of the at least two casing sections, in relation to an intended direction of drilling, the drilling tool configured to drill a diameter exceeding a largest diameter of the at least two casing sections of different diameter, the drilling tool comprising: a bit body having a face at a leading end thereof and an inner profile facing an inner bore of the at least two casing sections, the inner profile configured for engagement with a drilling profile of another drilling tool and comprising an at least substantially conic shape, an apex of the at least substantially conic shape being located nearer the at least two casing sections than a base of the at least substantially conic shape.

26. The drilling assembly of claim 25, wherein the at least two casing sections are, affixed to one another by shear pins.

27. The drilling assembly of claim 25, further comprising a motor disposed longitudinally between and coupled to the drilling tool and the innermost of the at least two casing sections.

28. The drilling assembly of claim 25, wherein the drilling tool comprises a casing bit operably coupled to the innermost of the at least two casing sections.

29. The drilling assembly of claim 25, wherein the drilling tool further comprises:

a first plurality of cutting elements of at least one type disposed over the bit body, the cutting elements of the at least one type each exhibiting an exposure; and a second plurality of cutting elements of at least another, different type disposed over the bit body, each cutting element of the at least another, different type exhibiting an exposure relatively greater than an exposure of a proximate cutting element of the at least one type.

* * * * *